US005507210A

United States Patent [19]

Paramest

[11] Patent Number: 5,507,210

[45] Date of Patent: Apr. 16, 1996

[54] TOGGLE JOINT BAND WRENCH APPARATUS

[76] Inventor: Sam Paramest, 17407 3rd Ave., SE., Bothell, Wash. 98012

[21] Appl. No.: 412,002

[22] Filed: Mar. 28, 1995

[51] Int. Cl.[6] ..... B25B 13/16

[52] U.S. Cl. ..... 81/170; 81/3.42; 81/155

[58] Field of Search ..... 81/170, 175, 3.42, 81/3.44, 3.37, 3.33, 3.36, 129, 155, 157, 176.3, DIG. 4

[56] References Cited

U.S. PATENT DOCUMENTS

| | | | |
|---|---|---|---|
| 674,914 | 5/1901 | Gansley | 81/176.3 X |
| 1,620,739 | 3/1927 | Presho | 81/175 X |
| 2,478,471 | 8/1949 | Edlund | 81/3.42 |
| 2,521,011 | 9/1950 | Hoskins | 81/3.42 |
| 3,119,290 | 1/1964 | Ivie | 81/3.42 X |
| 3,910,140 | 10/1975 | Rose | 81/176.3 |
| 4,012,971 | 3/1977 | Zeyhar | 81/170 |
| 4,033,205 | 7/1977 | Hoskins | 81/3.42 |

*Primary Examiner*—D. S. Meislin

[57] ABSTRACT

A toggle joint band wrench for an oil filter; comprises: A pair of side connectors bases which have three functional sets of systems connected between them to combine in functioning as a device. They are: (a) A set of toggle joint mechanisms connected pivotally between the upper parts to support the central toggle joint and its top handle on the top center of the device. (b) A clamping means connected between the middle pans to function for moving the side connectors closer or away from each other. (c) A pair of curved, laminated, toothed, clamping bands connected between the lower parts with a circular opening for an oil filter to be placed in-between them. A handle is connected to the top of the toggle joint pivotally. The clamping means can be adjusted to move the bands closer to each other in clamping and locking onto the oil filter. The toggle joint system keeps the handle constantly centralized. The handle can be flipped to be set on a lateral position in two positions across from each other. The handle also has a hexagon nut connected on the bottom end. The handle can be set to stand up at a 90 degree angle in relative to the clamping means and serves as an extension for a socket wrench to connect to the hexagon nut in driving the band wrench to rotate around.

2 Claims, 1 Drawing Sheet

TOGGLE JOINT BAND WRENCH APPARATUS

BACKGROUND OF INVENTION

1. Field of Invention

This invention relates generally to a band wrench for application in connecting or disconnecting a cylinder enclosure object, such as: an oil filter or jar cap to or from its threaded counter part.

2. Discussion of Prior Art

This invention is a new improvement of the invention to replace an application, the "*Mechanical Band Fastener*", application Ser. No. 08/349,743, filed with U.S. Patent and Trademark Office on Dec. 5, 1994, by the same inventor. The application Ser. No. 08/349,743, the "*Mechanical Band Fastener*", is now abandoned.

The old, band type oil filter wrench is a single, thin, circular metal band, which has a long handle on the side for lateral wrenching drive. Fastening this kind of band wrench to an oil filter of the engine block is awkward, inconvenience, and may be unsafe. The oil filter is usually located in a tight spot of an engine block which is crowded by other surrounding parts. The limited space is not best suited for the type of fixed, long handle band wrench which has its wrenching axis around the periphery of the cylinder oil filter. It requires a lot wider turn than a socket wrench application. Further weakness is the requirement of the lateral turning movement for the fastening process. Therefore, it reduces the available wrenching space to disengage the oil filter. Because of the design, slippery surface of the metal band, and the tight space combined, it is quite often that the band wrench may not get a good grip. It can slip off while fastening or wrenching; and may cause of a hand injury. The single, circular band wrench is not an effective and safe device. Therefore, a new, compact, safe, effective and efficient band type wrench, which has more mechanical functional features, as the "Toggle Joint Band Wrench Apparatus", is invented as an improvement in this field of art.

SUMMARY AND OBJECTS OF INVENTION

Summary of Invention

The "*Toggle Joint Band Wrench*" has a pair of side connector bases, which are the main connector bases of the device. There are three sets of the functional parts connected between the side connector bases. They are: (a) The toggle joint mechanism functional parts, which have a central toggle joint connected pivotally between a pair of elongated, side toggle bars. And each of the other ends of the side toggle bars is connected pivotally between the top part of the side connector bases. The connections of the central toggle joint and the toggle bars, which are bridged across between the two side bases are the hinging type linkage. The toggle joint mechanism parts are set to support the side connector bases and a top handle of the device. The handle is connected pivotally across the top part of the central toggle joint member. The toggle joint supporting system is the centralizing means in supporting and keeping the handle to be centralized constantly. (b) The fastening means has an elongated, hollow, threaded pipe connected to the middle part of one of the side connectors and is set horizontally; and has another elongated bolt connected through the other side connector to connect with the threaded pipe. The bolt can be driven into the pipe to adjust the distance between the two side connectors. (c) A pair of laminated, curved, toothed clamping bands are made for clamping. Each of the bands is connected to the lower part of each of the side connectors below the fastening means. The laminated bands are set to face their curved, toothed sides to form a circular opening between them. The oil filter or jar cap can be placed between the bands. The bands can be adjusted along with the side connector bases for clamping and locking the oil filter or jar cap.

Upon the adjustment to move the side connectors closer to each other for the clamping means, the movement also forces the side toggle bars to push the central toggle joint upwardly. It is the centralizing means to set the handle to be constantly on the center between the clamping bands.

After the oil filter is clamped and locked by the bands, the handle can be flipped over the central toggle joint to be set on one of the two lateral positions across from each other. The handle can be used directly to rotate the device from any of these two positions. The handle also has a block of hexagon nut connected to the center of the bottom end. The handle can be set in the upright position. It is to serve the handle as an extension for a socket wrench to connect to the hexagon nut to drive the device around.

The primary objects of this invention are:

(a) An object is for the effective lateral turning of the center handle drive of the band type wrench of this invention for the cylinder type object, which can be done with less turning space required than the old, single, circular band wrench.

(b) Another object is for the capacity of the utilization to fit with many sizes of the oil filters, such as an oil filter or jar cap or other with the adjustment feature of the vise grip and the laminated fastening bands combined.

(c) Further object is the centralizing means of the toggle mechanism of the invention to keep the handle constantly in the center between the two bands; whereas the band members of this device are subject to be adjusted to change their position in adjusting, clamping and locking on various sizes of oil filters and jar caps in different applications throughout the lifetime usage of this device.

(d) Another object are the multiple features of the handle for the convenience and effectiveness in designing the handle to set on the two opposite positions for the lateral drive functions; and the adaptation of the handle to serve as an extension connector for a type of wrench or socket wrench to apply the wrenching drive to engage or disengage the oil filter with the engine block.

(e) Further object is for time saving and effectiveness of the vise grip system of this device which bridged across the side connector bases for triple purposes of fastening, adjusting and locking functional.

(f) Another object is to combine: a handle with flexibility features, toggle mechanism parts, the adjustable side connector bases, the vise grip system, and the movable and laminated toothed bands to form into a compact and simple device, which is feasible for a mass production.

(g) An important object is for the safety of the user in designing the device with the combination of above vise grip drive system and the curved, resilient, bands, which having frictional synthetic toothed grip, to produce the effectiveness in adjusting, gripping, grasping and locking functions.

(h) An important object is to provide this mechanical device to be utilized effectively in a tight space of an engine block and in the poor environments, such as: on the ship, under water, or any extremely wet, windy and cold weather conditions, etc.

(i) Another object is to save time and energy of the user.

The foregoing objects, advantages, features and results of this invention, together with various other objects, advantages, features, and results thereof which will be in the light of the following detailed descriptions of the preferred embodiments along with the illustrations in the accompanying drawings.

BRIEF DESCRIPTION OF THE DRAWINGS

Remarks: (a) Each pair of parts which are identical will be identified with the same number with alphabet affix a and b.

Figure 1:
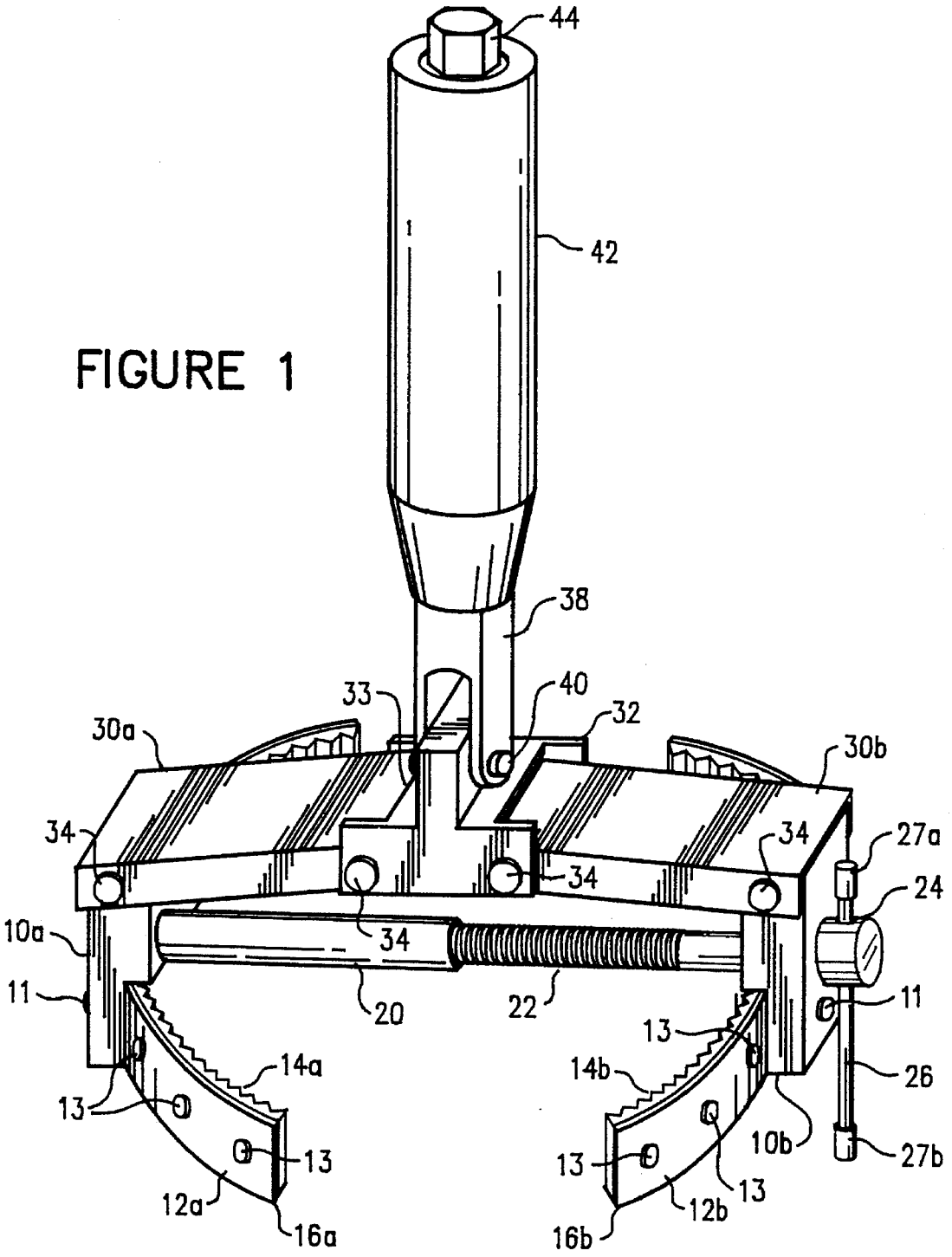
FIG. 1. A perspective top, side view of the invention.

(b) The plurality metal rivets, which are identical and are used in the same type of connection, will be identified with the same identification part number.

DETAILED DESCRIPTION OF INVENTION

FIG. 1 shows the "*Toggle Joint Band Wrench Apparatus*", which is for clamping and opening a cylinder object, such as an oil filter or a jar cap, comprising: A pair of the main, side connector bases 10*a* and 10*b*, which are made of a metal material through a molding production. There are three sets of the functional parts connected between the top, middle, and lower parts of the side connector bases, which are:

(a) Means for centralizing or a set of toggle joint mechanism functional parts, which has a central toggle joint 32 connected pivotally between the center ends of a pair of the side toggle bars 30*a* and 30*b*. And each of the other ends of the side toggle bars is connected pivotally between the top part of the side connectors 10*a* and 10*b*. Each spot of the hinging type connections, between the toggle bars and central toggle joint, and between the toggle bars and the side connector bases, has a provision of pivotal holes made for each of solid, metal rivet 34 to connect across horizontally. The toggle joint mechanism is made to support the side connector bases and an elongated handle 42. The handle 42 has a lower U shape handle rod 40 connected pivotally across the top part of a rectangular block 33 of the central toggle joint member with a rivet 40. The central toggle joint 32 and its upper block 33 are preferably made of a metal material as a single part through a molding production. And each of the side toggle bars is made through a metal stamping process to form into a U channel shape. The toggle joint supporting system is the centralizing means in supporting and keeping the handle to be centralized constantly.

(b) The fastening means or a set of vise grip system, which has an elongated, hollow, threaded pipe 20 connected at a 90 degree angle to the middle part of the side connector base 10*a* just below the toggle bar 30*a*; and has another elongated bolt 22 rotatable connected through the other side connector 10*b* with a loose-fit relationship. The bolt 22 is set to be level and connect with the threaded pipe 20. The bolt can be driven into the pipe to adjust the distance between the two side connector bases to be closer or away from each other. Whereby the toggle supports system prevents the side connector bases from tilting or twisting during the clamping means. The bolt 22 has a large cylinder head 24. The cylinder head 24 has a cross pivotal hole made for an elongated handle rod 26 to slide through loosely. The handle rod 26 has a pair of enlarged heads 27*a* and 27*b* made to enclose each of its ends. Therefore, the rod 26 can be slid to set as a handle on the two opposite side of the cylinder head in driving the threaded bolt 22 to engage with the pipe 20 for the adjustment to move the side connector bases for the clamping means.

(c) A pair of laminated, curved, toothed clamping bands 16*a* and 16*b*, each of which is connected to the lower part of each of the side connectors. The band 16*a* has an elongated, curved metal band 12*a*, which is made of a flat metal spring, on the back part; and a matching, flexible, toothed, band 14, which is made of a frictional synthetic material, on the front part. The band 16*b* also has the same identical set of the laminated metal band 12*b* on the back part and a matching, flexible, toothed, synthetic band 14*b* on the front part. Each set of the synthetic and metal bands are glued together and affixed with a row of six rivets 13. The center of the band 16*a* is connected to the lower part of the side connector 10*a* through a pair of rivets 11. The center of the band 16*b* is connected to the lower part of the side connector 10*b* with another pair of rivets 11. The toothed sides of the bands are set to face each other in forming a relative circular opening between them. The oil filter or jar cap can be placed between the bands. The bands can be adjusted to move along with the side connector bases during the fastening means to clamp and lock onto the oil filter or jar cap.

The centralizing means is the effect of the self-adjusting functional of the toggle mechanism to set the handle constantly in the center between the bands. The hinging connections, between the central toggle joint 32 and the side toggle bars members 30*a* and 30*b*, can be set to form a straight line of approximately a 180 degree toward each other. At this straight line setting, the side connector bases are also set to be apart at the widest position; and as a subsequent effect, the opening between the bands is also at the widest opening position. Whereas the fastening means is actuated to adjust and move the side connector bases horizontally toward each other to make the opening between the bands to be smaller for the clamping means; the toggles bars are also clamped by the side bases. The clamping pressure pushes the central toggle joint upwardly on the vertical plane. Therefore, each of the connections between the toggle bars and central toggle joint is changed to be less than 180 degrees accordingly. The fastening means can be driven to adjust the width of the opening between the clamping bands to clamp onto the different sizes of the oil filters or jar caps at the different times. During the fastening adjustment, the central toggle joint and handle, may move up and down according to the width between the side bases, however, they are being remained in the center between the bands at all time.

Upon the oil filter being clamped, the top handle has a feature to flip and set laterally on either side of the toggle bars, so that the handle can be used to begin in turning the wrench to rotate the oil filter from either position. The handle further has a hexagon nut 44 connected at the center of the bottom end. Therefore, the handle can be used as an extension connector by setting it to stand upright or at approximately a 90 degree angle relative to the top of the vise grip system. Therefore, a type of wrench or a socket wrench can be connected to the hexagon nut 44 of the handle for driving the toggle joint band wrench to rotate in a tight space as another option.

Although the description above contains a full and complete disclosure of this invention, these should not be construed as limiting the scope of the invention but as merely providing the preferred embodiment of the invention. The various modifications and alternates may be further employed without departing from the scope and spirit of this invention. Therefore, the scope and spirit of the invention should be determined by the appended claims and their legal equivalents.

I claim:

1. A toggle joint band wrench for grasping and turning an oil filter to connect to or disconnect from an engine block, comprising:

(a) a pair of rigid, adjustable, side connector base members, wherein each of said side connector base members having a top end, a middle part and a bottom end which set on vertical plane accordingly;

(b) a pair of rigid, elongated, straight, side toggle bars;

(c) a rigid, central toggle joint member;

(d) each side of said central joint member connected pivotally to one end of each of said side toggle bars;

(e) another end of each of said side toggle bars connected pivotally to said top end of each of said side connector bases;

(f) an adjustable handle connected pivotally to a top center of said central toggle joint member;

(g) a pair of curved, clamping band members, (h) said lower end of each of said side connector bases connected to a back center of each of said clamping bands to set each of said bands to face directly toward each other;

(i) fastening means, connected and linked between said middle parts of said side connector bases, to move, adjust and lock distance between said side connector bases and, in a meantime, to move and adjust said central toggle joint member to be centralized constantly;

(j) whereby said fastening means can be actuated manually to move said side connector bases to push said clamping bands to fasten onto said oil filter, and said central toggle joint member is also being moved simultaneously to adjust said adjustable handle to be constantly centralized between said clamping bands, and said handle can be actuated for turning said oil filter to connect to or disconnect from said engine block.

2. The invention of claim 1 wherein said adjustable handle further has a block of hexagon nut head connected on a bottom end of said handle, wherein said handle can be set to stand on an upright position at approximately 90 degree angle relative to said fastening means of said toggle joint wrench, so that said handle can be utilized as an extension connector for a type of wrenches, such as: a socket wrench to be engaged in connecting with said hexagon nut of said handle for driving and turning said toggle joint band wrench to rotate said oil filter in a tight space situation.

* * * * *